United States Patent [19]

Noguchi et al.

[11] 4,363,670

[45] Dec. 14, 1982

[54] CONTINUOUS PROCESS FOR INDUSTRIALLY PRODUCING MESOCARBON MICROBEADS

[75] Inventors: Kosaku Noguchi, Tokyo; Honami Tanaka, Izumi; Yukimasa Kumura, Izumi; Eiji Kitajima, Izumi; Noriyuki Tsuchiya, Izumi; Tomonori Sunada, Ootsu, all of Japan

[73] Assignee: Koa Oil Company, Limited, Japan

[21] Appl. No.: 222,901

[22] Filed: Jan. 5, 1981

[30] Foreign Application Priority Data

Jan. 4, 1980 [JP] Japan ..... 55-238

[51] Int. Cl.[3] ..... C08L 95/00

[52] U.S. Cl. ..... 106/278; 106/284; 208/45; 252/316

[58] Field of Search ..... 106/284, 278; 208/44, 208/45

[56] References Cited

U.S. PATENT DOCUMENTS 4,277,324 7/1981 Greenwood ..... 208/45

4,277,325 7/1981 Greenwood ..... 208/45

FOREIGN PATENT DOCUMENTS 657641 9/1951 United Kingdom .

*Primary Examiner*—John Kight, III

*Assistant Examiner*—Amelia B. Yarbrough

*Attorney, Agent, or Firm*—Wenderoth, Lind & Ponack

[57] ABSTRACT

Mesocarbon microbeads are continuously produced by the steps of: (1) mixing a matrix pitch, mesophase microspheres, and a solvent in which the pitch will dissolve but the microspheres will not, thereby to prepare a liquid mixture of a solution and dispersion; (2) processing the mixture in at least two stages of liquid cyclones, thereby to separate it into light and medium-weight liquids and a heavy liquid containing most of the microspheres; and (3) evaporating off the solvent from the heavy liquid thus obtained, thereby to obtain the microspheres as mesocarbon microbeads. The solvent is evaporated off from the light liquid to recover the pitch, and the medium-weight liquid is recycled to step (1) and (2).

7 Claims, 13 Drawing Figures

DISSOLVING VESSEL
3
4
5
EVAP.
11
37
14
10
7A
19
60
21
26
EVAP.
25
38
16A
71
29
EVAP.
30
39
70
80
RESERVOIR
SEPARATION SECTION
44
SOLVENT RESERVOIR 91
93
97
99
92
94
96
98
95

X1000

X1000

X1000

X1000

CONTINUOUS PROCESS FOR INDUSTRIALLY PRODUCING MESOCARBON MICROBEADS

TECHNICAL FIELD

This invention relates to a continuous process for industrially producing mesocarbon microbeads which are carbon precursors of particulate form having optical anisotropy.

BACKGROUND ART

The production of mesocarbon microbeads (hereinafter referred to by the abbreviation MCMB) by separating microspheres (mesophase microspheres) formed by a process wherein a heavy oil such as a petroleum heavy oil or coal tar is subjected to a heating and carbonization treatment and having optical anisotropy from the matrix pitch is known (as disclosed in, for example, Japanese Pat. Publn. Nos. 9639/1977 and 9599/1978).

The individual microspheres or particles of the MCMB obtained in this manner may be considered to have a structure wherein polycyclic aromatic hydrocarbons which are, to a high degree, aligned and laminated in a specific direction. Because of this unique form and crystalline structure, these MCMB have high electrical, magnetic, and chemical activities, and extensive utilization thereof in various diversified fields is expected. More specifically, it has been expected to utilize these MCMB for production of various industrial materials, examples of which are: special carbon materials such as high-density isotropic carbon materials and electrical resistance carbons prepared by carbonization after molding thereof; composite materials such as electroconductive ceramics, dispersion-reinforced metals, and electroconductive plastics prepared by carbonizing the MCMB as they are and thereafter blending the resulting material with other materials; and chemical materials such as catalyst supports and packing material for chromatography. (Reference is made, for example, to Yamada and Honda: Sekiyu Gakkai-shi (Journal of the Japan Society of Petroleum Engineers) 16, 392, (1973) and "Saikin·Kuro no Sekiyū-Kagaku no Kaihatsu Jitsuyō-ka Gijutsu Shū" ("Collection (of papers on) Development and Practicalization Technology of Recent Black Petroleum Chemistry") edited by Nippon Gijutsu Keizai Sentah (Japan Technology Economy Center)(1976)).

These MCMB can be obtained by suitably heat treating heavy oil to obtain a starting-material pitch containing mesophase microspheres, mixing this pitch with an aromatic solvent such as quinoline, pyridine, or anthracene oil to selectively dissolve a matrix pitch, and recovering the mesophase microspheres (i.e., the MCMB) as the insoluble component. However, for obtaining MCMB in this manner, only laboratory techniques such as filtration and centrifugal separation have heretofore been proposed, and satisfactory techniques have not yet been established for production on an industrial scale because of several problems such as those enumerated below.

(a) Since the MCMB content in the starting-material pitch is very low (low conversion yield from the starting-material heavy oil to MCMB), a large quantity of the solvent such as quinoline or anthracene oil becomes necessary, whereby economical production is difficult. Furthermore, these solvents are toxic or have an irritating odor and thereby require large-scale measures for pollution prevention.

(b) When a suction filtration method is carried out in order to separate the MCMB after the pitch is dissolved in an aromatic solvent such as quinoline, the very small particle size of the MCMB (ordinarily from 1 to a number of tens of microns) and the formation of colloids due to solvation readily give rise to clogging of the filter material, whereby the separation requires a long time, and the operation becomes very inefficient. Furthermore, even in the case of centrifugal separation, the state of the art is such that means for treating batchwise samples of a specific quantity have merely been considered, which procedure cannot be said to be an efficient operation capable of being practiced on an industrial scale.

(c) Ordinarily, the particle size of MCMB is distributed over a range of from one micron to several tens of microns. In order to obtain a high practical value of MCMB, it is necessary to narrow the particle size distribution or to carry out a classification process for adjusting the beads to a specific particle size distribution. However, because of small sizes of the particles, an economical classification is difficult.

SUMMARY OF INVENTION

It is an object of this invention to provide a continuous process for producing MCMB in which the above described problems accompanying the prior art have been overcome.

As a result of our research, we have discovered that the above mentioned problems of the prior art can be substantially overcome by the process of this invention which includes the use of multiple stages of liquid cyclones.

According to this invention, briefly summarized, there is provided a process for continuously producing mesocarbon microbeads which comprises the steps of:

(a) mixing in a dissolving vessel (1) a starting-material pitch comprising mesophase microspheres and a matrix pitch obtained by heat processing a heavy oil and (2) a solvent in which the matrix pitch will dissolve but the mesophase microspheres will not dissolve thereby to obtain a liquid mixture comprising a solution of the matrix pitch dissolved in the solvent and dispersed mesophase microspheres;

(b) supplying the liquid mixture thus obtained in step (a) into at least two stages of liquid cyclones thereby to separate the mixture into a light liquid comprising principally the matrix pitch and the solvent, a medium-weight liquid containing the matrix pitch and the solvent as well as a small portion of fine mesophase microspheres, and a heavy liquid containing the solvent as well as most of the mesophase microspheres;

(c) evaporating the solvent from the light liquid thus obtained in step (b) thereby to separate and collect the matrix pitch;

(d) recycling the medium-weight liquid thus obtained in step (b) to step (a) or step (b); and (e) removing the solvent from the heavy liquid thus obtained in step (b) thereby to obtain mesophase microspheres and mesocarbon microbeads.

The liquid cyclones used in the practice of this invention, in comparison with conventional techniques for separation such as filtration or simple centrifugation, have, in addition to mere continuous solid-liquid separation operation, the functional capabilities of washing and classifying solid particles as a result of their use in multiple stages. For this reason, this invention is characterized in that the operations of solid-liquid separation, washing, and classification, which are necessary for continuous production of MCMB, are simultaneously accomplished by the use of multiple stages of liquid cyclones.

The nature, utility, and further features of this invention will be more clearly apparent from the following detailed description, beginning with a consideration of general aspects of the invention and concluding with specific examples of practice illustrating preferred embodiments of invention, when read in conjunction with the accompanying illustrations comprising drawings and photographs as briefly described below.

ILLUSTRATIONS

In the illustrations:

FIGS. 1, 2, and 3 are flow charts respectively indicating, in schematic form, apparatus systems for practicing the process of this invention;

FIG. 4 is a flow chart showing, in schematic form, an apparatus system used in experiments;

FIGS. 5*a*, 5*b*, and 5*c* are graphs respectively indicating distributions of MCMB particle size prior to and after processing with multistage liquid cyclones;

FIGS. 6*a*, 6*b*, and 6*c* are photographs taken with a magnification of 1,000 times through a scanning electron microscope respectively of the MCMB particles in the above stated state;

FIGS. 7*a* and 7*b* are graphs respectively indicating distributions of MCMB particle size prior to and after processing with multistage operation of a liquid cyclone; and FIG. 8 is a photograph taken with a magnification of 1,000 times through a scanning electron microscope.

DETAILED DESCRIPTION

Throughout the following disclosure, quantities expressed in "percent (%)" and "parts" are by weight unless otherwise stated.

Figure 1:
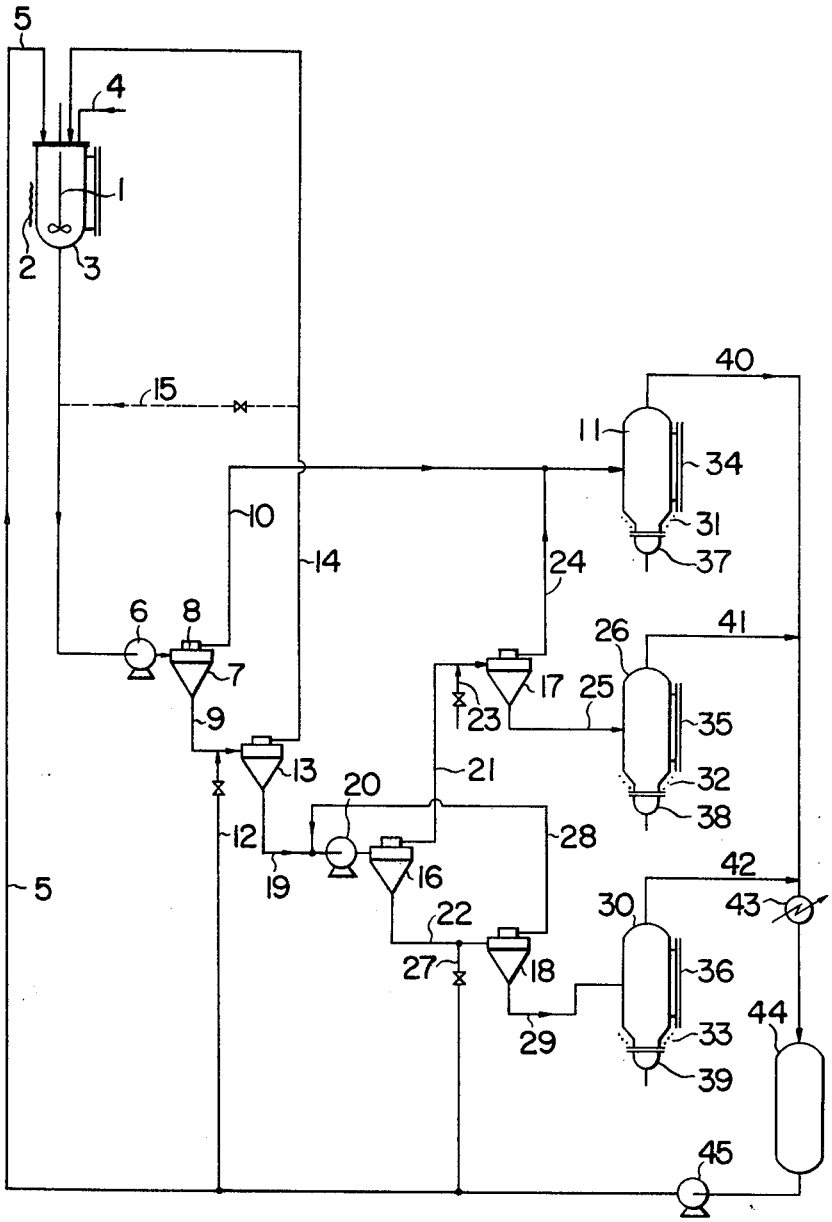

Referring first to FIG. 1, the flow chart thereof shows the essential organization of apparatus for practicing one relatively basic mode of the MCMB production process of this invention. In FIG. 1, for the sake of clarity, accessory components such as valves have been deleted except for a minimum number thereof necessary for description, and, with respect to a plurality of itens of equipment having the same function and used interchangeably by switching or in parallel, only one item of each group is shown.

In the mode of practice of the process of this invention indicated in FIG. 1, a dissolving vessel 3 equipped with agitator vanes 1 and a heater 2 and having a capacity of 1 $m^3$ is fed at a rate of approximately 60 kg/hr. through a flow path 4 with a starting-material pitch in powder particle state containing together with matrix pitch approximately 5 percent of mesophase microspheres of the particle size distribution set forth below and obtained by heating residual oil of fluid catalytic cracking at 450° C. The entire system is maintained at approximately 80° C.

| Particle Size (microns) | Percent |
|---|---|
| 0 to 2 | 0.1 |
| 2 to 5 | 3.5 |
| 5 to 10 | 32.2 |
| 10 to 15 | 47.7 |
| 15 to 20 | 16.5 |

Separately, through a flow path 5, quinoline, which dissolves the matrix pitch but does not dissolve the mesophase microspheres, is supplied at a rate of 600 kg/hr into the dissolving vessel 3. Then the starting-material pitch and the solvent are mixed along with 330 kg/hr of recycle stream from line 14 comprising the matrix pitch, a minor proportion of microspheres and the solvent as they are heated by the heater 2 thereby to obtain a liquid mixture in which MCMB or mesophase microspheres are dispersed in a solution of the matrix pitch dissolved in the solvent.

Next, this liquid mixture is introduced via a pump 6 at a rate of 990 kg/hr into two liquid cyclones 7 (only one shown in FIG. 1 as stated hereinbefore) in parallelly connected arrangement. Each of these liquid cyclones comprises an upper cylindrical part of a diameter of 10 mm and a lower conical part joined at its base to the upper part, the total length of the cyclone being 50 mm. A light-liquid (overflow) draw-off pipe 8 is connected to the central part of the cylindrical upper part of the cyclone, while a heavy-liquid (underflow) draw-off pipe 9 is connected to the lower vertex part of the conical lower part. For the succeeding cyclones 13, 16, 17, 18, etc., also, cyclones of substantially the same dimensions and of suitable number as necessary are used.

The above mentioned liquid mixture is introduced in the tangential direction into the cylindrical upper part of each cyclone 7 and, as it revolves along the inner wall of this cylindrical upper part, is separated into a heavy liquid rich in MCMB and a light liquid with a low concentration of MCMB, which are drawn off respectively at a rate of 330 kg/hr and 660 kg/hr through the flow path 9 and a flow path 10 connected to the draw-off pipe 8.

The light liquid drawn off from the liquid cyclones 7 comprises principally the matrix pitch and the solvent, and even if MCMB are contained therein, only a very small quantity of MCMB of very minute particle size are present. This light liquid is passed through the flow path 10 and is introduced into an evaporator 11 of 10-$m^3$ capacity.

On the other hand, the heavy liquid from the liquid cyclones 7 is a liquid mixture comprising a solution of the pitch and the solvent in which MCMB having a large to small distribution of particle size is dispersed in a concentrated state. This liquid mixture, together with supplementary solvent supplied at a rate of 330 kg/hr through a pipe line 12, is introduced into two second liquid cyclones 13. In the liquid cyclones 13, the liquid mixture from the liquid cyclone 7 is similarly separated into a light liquid (which is a medium-weight liquid in comparison with the light liquid drawn off through the pipe 10 from the cyclone 7) containing a minor proportion of MCMB of relatively small particle size and a heavy liquid containing MCMB of relatively large particle size. The light liquid is drawn off at a rate of 330 kg/hr through the pipe line 14 and is recycled to the dissolving vessel 3. Depending on the necessity, it is also possible to recycle the light liquid flowing through the pipe line 14 back to the dissolving vessel 3 as indicated by intermittent line in FIG. 1. Furthermore, since recycling in this manner is carried out in order to increase the rate of recovery of the MCMB by the system of the liquid cyclones 7, 13, and so forth, recycling in a similar manner to the upstream part of the liquid cyclone system as shown by the pipe line 15 indicated by intermittent line can be carried out instead of or in addition to the recycling to the vessel 3, depending on the necessity.

If the heavy liquid from the liquid cyclones 13 is amply washed by the solvent supplied through the pipe line 12, the matrix pitch is removed, and a liquid mixture substantially of only the solvent and the MCMB can be obtained. However, in order to amply remove the matrix pitch from the MCMB and, furthermore, to classify the MCMB into desired particle sizes, it is desirable to further process the heavy liquid from the liquid cyclones 13 in the cyclone system for classification comprising the liquid cyclones 16, 17, 18, etc., as shown in FIG. 1.

More specifically, the heavy liquid drawn off at a rate of 330 kg/hr from the liquid cyclones 13 is introduced via a flow path 19 and a pump 20 into four liquid cyclones 16 disposed in parallel, in which it is again separated into a light liquid and a heavy liquid, which are introduced at a rate of 330 kg/hr respectively through flow paths 21 and 22 into the liquid cyclones 17 and 18. Depending on the necessity, the light liquid from the cyclones 16 is diluted with the solvent from a flow path 23 (not used in the instant example) and thereafter introduced into one cyclone 17, where it is further separated into a light liquid and a heavy liquid. The light liquid thus separated, which is a solvent containing some dissolved pitch, is drawn off at a rate of 165 kg/hr through a flow path 24 and, together with the light liquid from the pipe line 10, is sent to the evaporator 11. The heavy liquid thus separated is sent at a rate of 165 kg/hr through a flow path 25 to an evaporator 26 of a capacity of 2 $m^3$.

On the other hand, the heavy liquid from the cyclones 16 is diluted, depending on the necessity, with solvent (330 kg/hr in the instant example) from a pipe line 27 and thereafter introduced into four cyclones 18. The light liquid withdrawn from the cyclones 18 is fed back at a rate of 330 kg/hr through a flow path 28 to the supply pump 20 of the cyclones 16. The heavy liquid is sent through a flow path 29 at a rate of 330 kg/hr to an evaporator 30 of 5-$m^3$ capacity.

Except for differences in volumetric capacity, the evaporators 11, 26, and 30 possess substantially the same function and are respectively provided with heaters 31, 32, and 33, liquid level gages 34, 35, and 36, detachable bottom sumps or pots 37, 38, and 39, and, if necessary, evacuating equipment (not shown). These evaporators are operated batchwise.

The liquid introduced into the evaporator 11 comprises principally the solvent and the soluble component in the starting-material pitch and contains a very minute quantity of MCMB. In the evaporator 11, the solvent is evaporated at approximately 90° C. under reduced pressure, whereby an evaporation-dried substance comprising principally a soluble pitch component is obtained in the bottom pot 37. This evaporation-dried substance is a pitch which contains almost no mesophase microspheres. By again heat treating this pitch, it can be caused to form anew a mesophase to be used as a starting material of the instant system.

On the other hand, the liquids supplied to the evaporators 26 and 30 are dispersions comprising the solvent and MCMB respectively of relatively small and large particle size dispersed in the solvent. By evaporating the solvent in the evaporators 26 and 30, MCMB principally of a particle size less than 10 microns are collected at a rate of approximately 1.2 kg/hr in the bottom pot 38, while MCMB principally of a particle size greater than 10 microns are collected at a rate of approximately 1.8 kg/hr in the bottom pot 39.

Solvent vapor generated by evaporation at atmospheric or reduced pressure is discharged from the tops of evaporators 11, 26, and 30 and, flowing through piping 40, 41, and 42 respectively at rates of 768, 164, and 328 kg/hr, is condensed in a condenser 43, the condensate being collected in a solvent reservoir 44. The solvent thus recovered and collected is pumped by a pump 45 and sent through the piping 5, 12, 23, 27, etc., back to the dissolving vessel 3 and to the cyclones 13, 17, 18, etc., to be utilized for washing MCMB or diluting liquid mixtures.

In FIG. 1, only one unit each of the evaporators 11, 26, and 30 is shown for the sake of simplicity. In an actual apparatus, however, at least one spare unit is provided for each of these items of equipment so that, by interchangeably switching, continuous operation is carried out. That is, continuous operation of the apparatus is made possible even during the time required for dissolving the starting material pitch and during the recovery of solid pitch and MCMB by detachment of the bottom pots of the evaporators.

Figure 2:
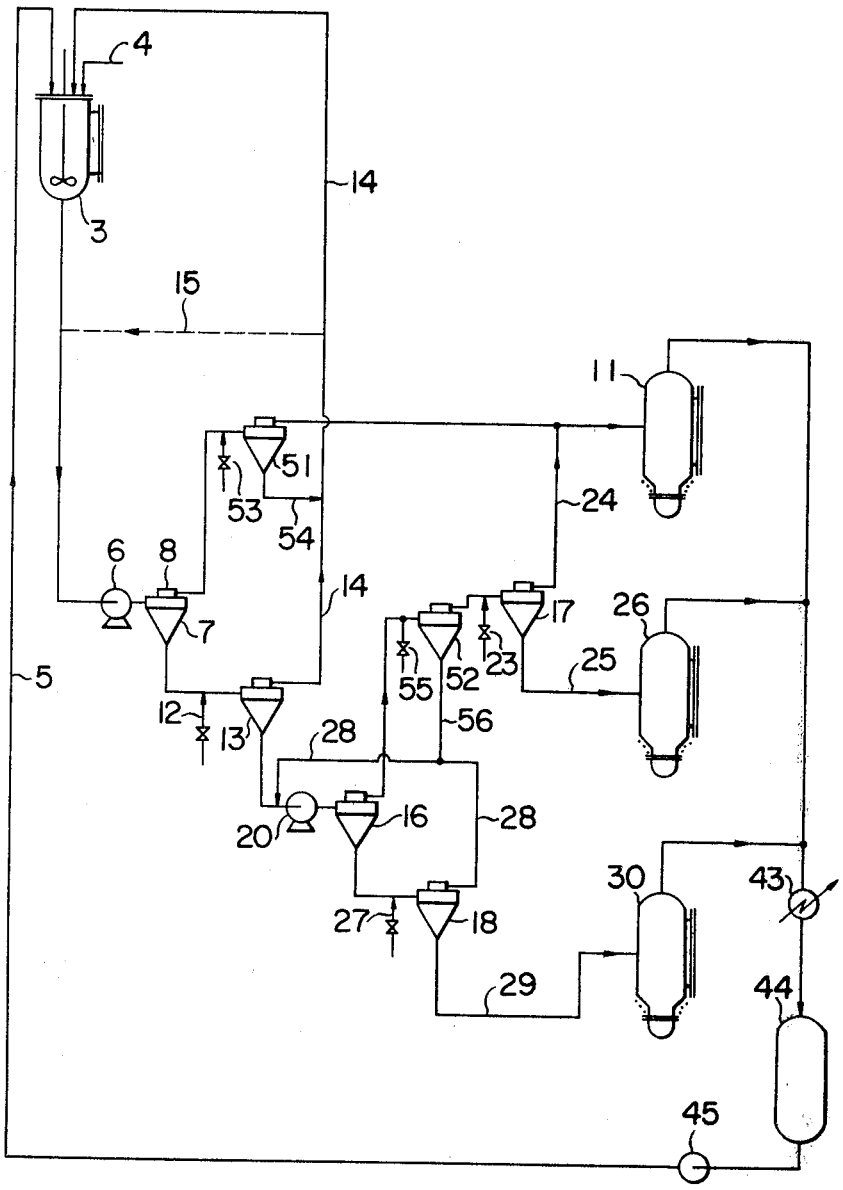

The apparatus shown in FIG. 2 is similar to that illustrated in FIG. 1 and described above, except that, before the light liquids of the cyclones 7 and 16 are sent to succeeding steps, they are further treated in liquid cyclones 51 and 52, whereby the MCMB recovery and classification effects can be enhanced. In FIG. 2, those parts which have substantially the same function as corresponding parts in FIG. 1 are designated by like reference numerals. More specifically, in the case where the light liquid from the cyclone 7 contains a small quantity of MCMB, it is introduced, together with solvent introduced through a flow path 53, depending on the necessity, into the cyclone 51, and MCMB are recovered on the heavy liquid side and recycled through a flow path 54 and the flow path 14 or 15 to the upstream side of the cyclone 7. In this manner, the quantity of the MCMB introduced into the evaporator 11 can be reduced.

Furthermore, in the case where MCMB of relatively large particle size is admixed in the light liquid from the cyclone 16, this light liquid is introduced, together with solvent introduced through a pipe line 55, into the cyclone 52, the heavy liquid of which is recycled through pipe lines 56 and 28 to the upstream side of the cyclone 16. In this manner, the quantity of MCMB of relatively large particle size sent toward the cyclone 17 can be reduced.

As will be apparent from the foregoing description, the cmbination as illustrated in FIG. 2 of three cyclones 7, 13, and 51 and two recycling lines 14 (or 15) and 54 (or similarly the combination of three cyclones 16, 18, and 52 and two recycling lines 28 and 56) has a function similar to one cyclone. However, by the use of such a combination, the separation or classification effect is remarkably enhanced, and, furthermore, by providing intermediate piping or introducing solvent through the pipe line 53, the washing of MCMB can be promoted.

The combination as illustrated in FIG. 1 of two stages of cyclones 7 and 13 and one recycling line 14 (or 15) (and the combination of two stages of cyclones 16 and 18 and one recycling line 28) also have the same function as one stage of cyclones. When the importance of cyclones 13 and 51 with respect to the cyclone 7 in the apparatus shown in FIG. 2, for example, are compared, the cyclone 13 is more important. The reason for this is that, as a characteristic of liquid cyclones, in a liquid cyclone having a specific classification zone, the rate at which MCMB of particle sizes less than the lower limit becomes admixed into the heavy liquid side is greater than the rate at which MCMB of particle sizes exceeding the upper limit admixed into the light liquid size. Accordingly, in order to collect and classify the MCMB with high efficiency through the use of mutlistages of liquid cyclones, it is desirable to determine the arrangement of the cyclones in accordance with this characteristic of liquid cyclones.

Furthermore, each of the combination of the cyclones 7 and 13 in FIG. 1 and the combination of the cyclones 7, 13, and 51 in FIG. 2 is one having two stages in series arrangement, but it will be readily apparent that, depending on the necessity, by combining more stages of cyclones and recycling lines, the combination can be caused to possess a function equivalent to that of a cyclone of one stage while further improving the classification effect or the intermediate washing effect resulting from the greater number of stages.

Figure 3:
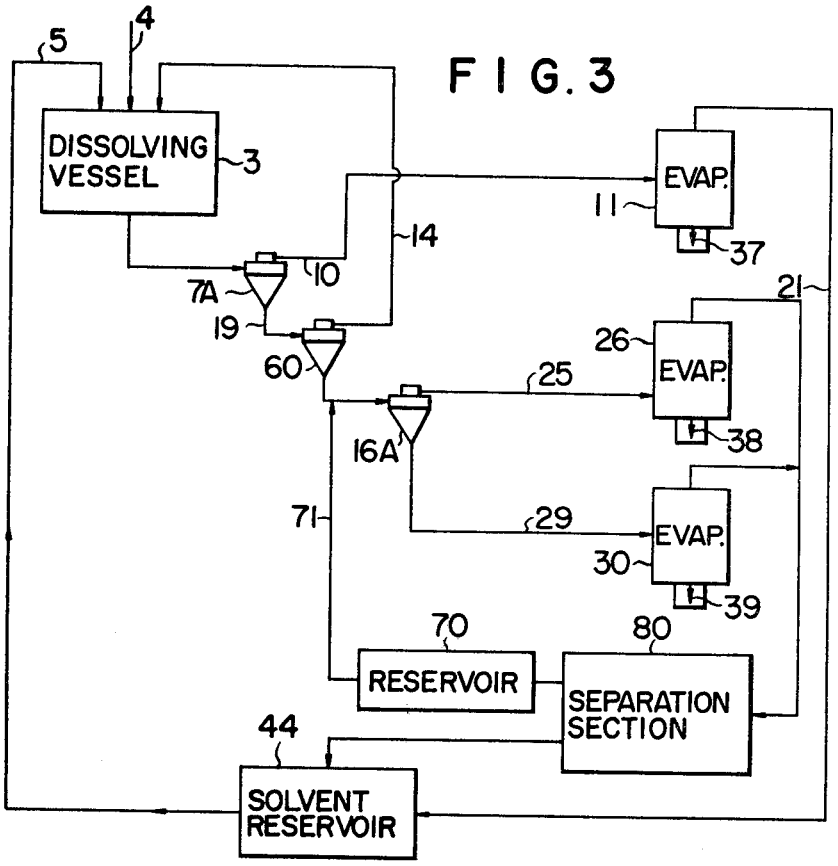

An apparatus system in which two kinds of liquids are jointly used is shown in FIG. 3, in which some components are indicated in block form for the sake of simplicity. That is, an aromatic solvent such as quinoline or anthracene oil (hereinbelow referred to as solvent with reference to FIG. 3) has a strong dissolving power with respect to the matrix pitch in the starting-material pitch. However, it is desirable to keep its use at a minimum because of its disadvantageous features such as its harmful effect on the human body, acrid smell, and high price.

In the production of MCMB according to this invention, a solvent of a strong dissolving power is required, basically, in only the MCMB separation and washing sections including the cyclones 7 and 13 in the system illustrated in FIG. 1 or the cyclones 7, 13, and 15 in the system shown in FIG. 2, and, in the section thereafter for classification of the MCMB, any liquid which can serve as a dispersion medium for the MCMB can be used. In view of these requirements, in the section for classification in the apparatus system shown in FIG. 3, a non-aromatic liquid such as kerosene (paraffin oil), light oil, alcohols, or water (hereinafter referred to as dispersion medium) is used together with a dispersion aid which is used optionally.

In FIG. 3, those equipment parts having functions similar to those of corresponding parts in FIGS. 1 and 2 are designated by like reference numerals. In the system indicated in FIG. 3, starting-material pitch supplied through a flow path 4 and a solvent supplied through a flow path 5 are mixed in a dissolving vessel 3, where the matrix pitch is dissolved. Thereafter, the resulting liquid mixture is introduced into a separation and washing section 7A (corresponding to the section including the pump 6, cyclones 7, 13, and 51, and flow paths 12 and 53 of the solvent for washing in the system illustrated in FIG. 2). In this section 7A, MCMB is substantially removed from the solvent. The resulting solution of this solvent and most of the matrix pitch is sent via a flow path 10 to an evaporator 11.

On the other hand, a liquid mixture comprising MCMB, a matrix pitch, and solvent from the separation and washing section 7A is introduced through a flow path 19 into a concentration section 60. This concentration section 60 also comprises a group of liquid cyclones and, if necessary, an intermediate washing flow path of the solvent and operates to separate substantially the entire quantity of the matrix pitch, most of the solvent, and a very small quantity of MCMB remaining on the light liquid side and to recycle the same via a flow path 14 to the dissolving vessel 3.

On the other hand, as the heavy liquid from the concentration section 60, a greater part of MCMB and a small quantity of the solvent are drawn off and, together with a dispersion medium supplied from a reservoir 70 via a flow path 71, are conducted to a classification section 16A (corresponding to the section including the cyclones 16, 17, 18, 52, etc., in the system shown in FIG. 2 except that a flow path corresponding to the flow path 24 is not formed). A light liquid containing MCMB of relatively small particle size from this classification section 16A is conducted by way of a flow path 25 to an evaporator 26, while a heavy liquid containing MCMB of relatively large particle size is introduced through a flow path 29 to an evaporator 30.

In the evaporators 11, 26, and 30, a dried solid substance of the matrix pitch, MCMB of relatively small particle size, and MCMB of relatively large particle size are respectively collected in the bottom pots 37, 38, and 39 as a result of evaporation of the solvent or the dispersion medium. Furthermore, the solvent evaporated in the evaporator 11 is discharged from its top and, passing through and being condensed in a condenser, is collected in a reservoir 44. On the other hand, from the tops of the evaporators 26 and 30, the solvent and the dispersion medium are recovered as a mixture. This mixture is separated in a separation section 80 into the solvent which is then collected in the solvent reservoir 44 and the dispersion medium which is then collected in the dispersion medium reservoir 70. This separation in the separation section 80 is carried out by a method such as simple distillation, gravitational separation, and supplementation and drawing off of the solvent. For this reason, a dispersion medium having a property convenient for separation, such as a boiling point differing appreciably from that of the solvent or incompatibility with the solvent is selected.

As described above, this invention provides an efficient process for continuously producing MCMB in which, through the use of multiple stages of liquid cyclones, separation from matrix pitch, washing, and classification of MCMB, which constitute unit operations in the production of MCMB, are accomplished at the same time. Moreover, from the characteristics of liquid cyclones, important advantages such as the following are attained.

(a) Since even a small liquid cyclone of the order of a 10-mm diameter and 50-mm length has a high processing capacity in terms of liquid throughput rate of 500 to 1,000 liters/hr, a large space is not necessary even when a greater number of liquid cyclones are used in combination.

(b) Since the fundametal method of scaling up the output is not by increasing the size of the liquid cyclones but by the use of a large number of small cyclones in parallel connection, scaling up is facilitated.

(c) Except for the use of pumps in the process, necessary moving parts are few.

(d) Because multiple functions can be simultaneously accomplished by the use of multiple stages of cyclones, the apparatus equipment is greatly unified.

(e) Since the cyclones also have a concentrating effect, the load on the evaporators requiring a high consumption of heat energy is reduced.

(f) Since there are few movable parts and few restrictions relating to construction, heating is facilitated. For this reason, the quantity used of the solvent can be readily decreased by increasing its dissolving power through heating, and the solid-liquid separation operation can be easily simplified by lowering the solution viscosity through heating.

In order to indicate more fully the nature and utility of this invention, the following examples of experiments are set forth, it being understood that these examples are presented as illustrative only and are not intended to limit the scope of the invention.

EXPERIMENT 1

Figure 4:
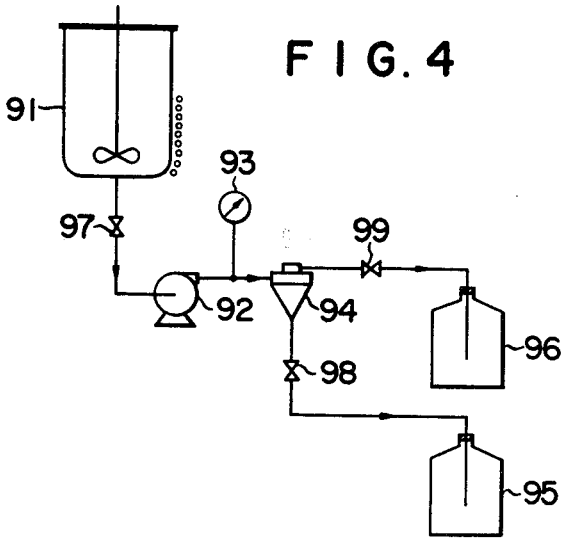

Residual oil from fluid catalytic cracking was heated to 450° C. at a temperature increasing rate of 3° C./min. in a stream of nitrogen gas and was heat treated at this temperature for 90 minutes. With the petroleum pitch thus obtained as a starting material, and with the use of an experimental apparatus as indicated in FIG. 4, separation and classification of MCMB contained in the pitch were carried out. The MCMB content in the pitch was found to be 4.9 percent by weight, as measured in accordance with Japanese Industrial Standards, JIS K 2425. The apparatus illustrated in FIG. 4 comprises a dissolving vessel 91 of 200-liter volumetric capacity provided with an agitator and an electric heater, a liquid transfer pump 92, a liquid cyclone 94, glass receiving vessels 95 and 96, a pressure gage 93, and valves 97, 98, and 99 in the arrangement shown.

A commercially available liquid cyclone 94 of a diameter of 10 mm and a length of 50 mm was used.

18 kg of the above mentioned pitch, which had been suitably crushed, and 180 kg of quinoline as the solvent were charged into the dissolving vessel 91, heated to 80° C., and agitated thereby to produce a feed solution in which the pitch was dissolved. This solution was pumped by the pump 92 with an inlet pressure of 10 kg/cm$^2$ gage through the cyclone 94, the overflow (light liquid) and the underflow (heavy liquid) of which were conducted respectively into the receiving vessels 96 and 95. The quantities and MCMB concentration of the liquid thus collected in each of these receiving vessels were measured, whereupon the results shown in Table 1 were obtained. These results indicate that the liquid sent into the cyclone 94 is divided evenly into portions of 50 percent each to constitute the overflow and underflow, respectively, and that, moreover, 91 percent of the MCMB is collected on the underflow side.

From this it is apparent that the MCMB is concentrated by the cyclone on the underflow side and, conversely, is diluted on the overflow side, that is, the effect of solid-liquid separation is amply exhibited.

TABLE 1

| | |
|---|---|
| Operational conditions | |
| Inlet pressure, cyclone, kg/cm$^2$: | 10 |
| Inlet flow rate, cyclone, liter/min.: | 5.6 |
| Operation temperature, °C.: | 80 |

TABLE 1-continued

| | |
|---|---|
| Solvent: | quinoline |
| Pitch/solvent, weight ratio: | 1/10 |
| Number of cyclone stages: | 1 |
| MCMB concentration of feed solution, % by wt.: | 0.224 |
| Operational results | |
| Underflow/(starting-material solution) flow rate ratio, wt/wt: | 50/100 |
| MCMB concentration of underflow liquid, % by wt: | 0.41 |
| Rate of collection of MCMB on underflow side: *1 | 0.91 |
| Degree of concentration of MCMB on underflow side: *2 | 1.83 |

$$*1\ \text{Collection rate} = \frac{\left(\text{Underflow flow rate}\right) \times \left(\text{MCMB concentration of underflow}\right)}{\left(\text{Inlet flow rate cyclone}\right) \times \left(\text{MCMB concentration of feed solution}\right)}$$

$$*2\ \text{Concentration degree} = \frac{\text{MCMB concentration of underflow}}{\text{MCMB concentration of feed solution}}$$

EXPERIMENT 2

An operation similar to that of Experiment 1 was carried out except that a series of 8 stage cyclone operations was used. In this experiment, only the liquid obtained from the underflow of the cyclone in FIG. 4 was fed back to the vessel 91, and the feed operation was again repeated 8 times in total.

The operation was carried out at a cyclone inlet pressure of 10 kg/cm$^2$ and a liquid temperature of 80° C., and the flow rate was 5.6 liter/min.

Figure 5A:
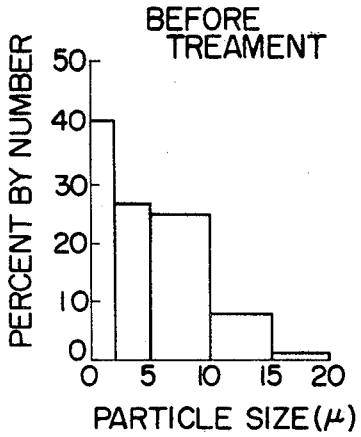
Figure 5B:
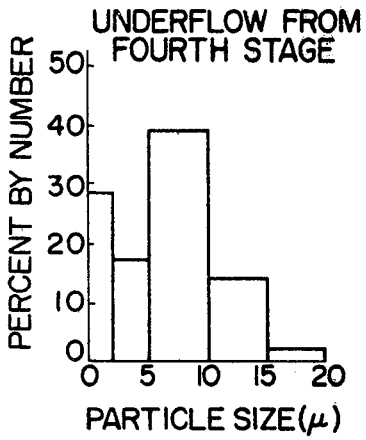
Figure 5C:
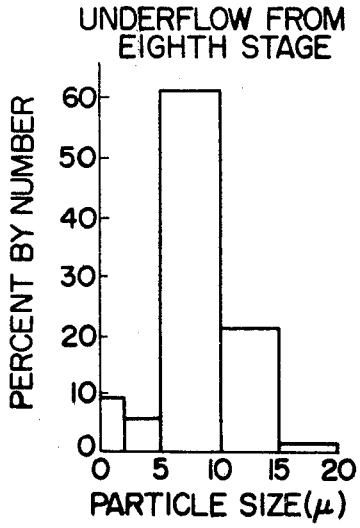
Figure 6A:
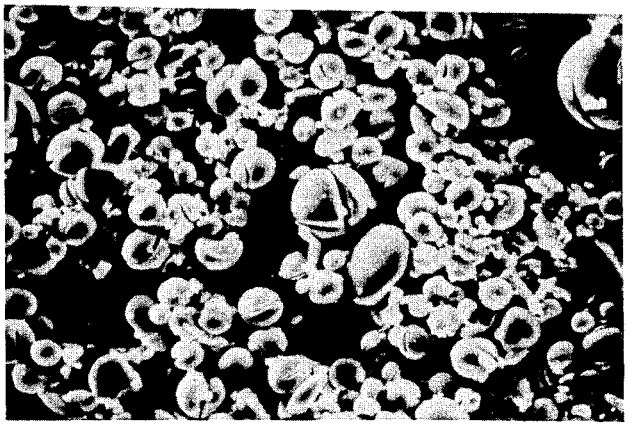
Figure 6B:
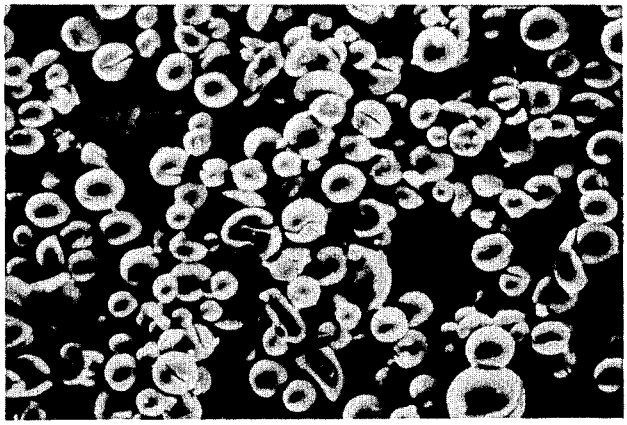
Figure 6C:
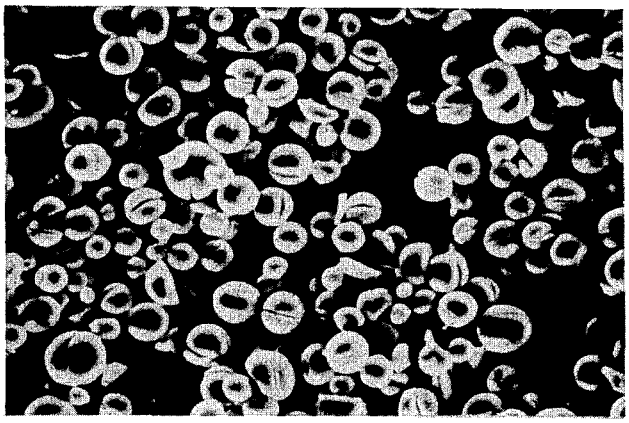
Figure 7A:
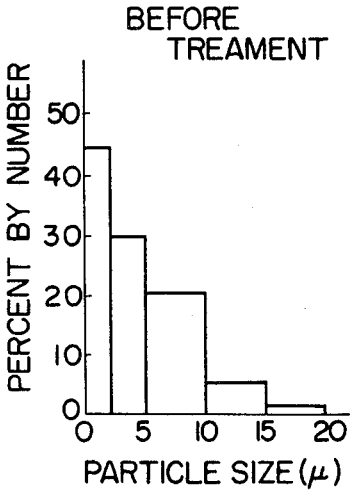
Figure 7B:
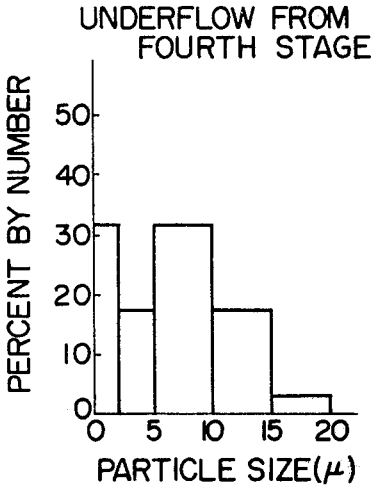

The distributions of MCMB particle size prior to processing, of the underflow of the fourth-stage cyclone operation, and of the underflow of the eighth-stage cyclone operation are respectively indicated in FIGS. 5*a*, 5*b*, and 5*c*. Corresponding photographs, of a magnification of 1,000 times, taken through a scanning electron microscope of the MCMB are shown in FIGS. 6*a*, 6*b*, and 6*c*, respectively.

As is apparent from these results that the MCMB prior to processing is ununiform, being a mixture of particles of various sizes and containing particularly a large number of particles of small sizes under 5 microns. However, as the process progresses through the fourth and eighth stages, small particles of sizes less than 5 microns are progressively eliminated from the underflows, and the MCMB assume a state of uniformity with particles of approximately 10-micron size constituting a median. It will also be apparent that the instant process also has an ample classification effect.

EXPERIMENT 3

Petroleum oil pitch obtained by heat treating the residual oil from fluid catalytic cracking for 120 minutes at 450° C. was suitably crushed. Then, similarly as in Experiments 1 and 2, the pitch was dissolved in quinoline of a quantity 10 times that of the pitch, and thereafter the resulting solution was processed in the apparatus shown in FIG. 4 with a cyclone inlet pressure of 3 kg/cm$^2$ gage. Only the liquid obtained from the underflow of the cyclone 94 was fed back to the vessel 91 and the resulting liquid was repeatedly processed to accomplish a four-stage process operation.

With respect to a cyclone inlet flow rate of 3.0 liters/min and an MCMB concentration of the solution prior to processing of 0.466 percent by weight, the MCMB concentration of the underflow of the fourth-stage cyclone operation was 2.528 percent by weight. The distributions of the particle size of the MCMB prior to processing and in the underflow of the cyclone of the fourth-stage are indicated in FIGS. *7a* and *7b*. It is apparent from these results that, in spite of the fact that, not only the inlet pressure and flow rate of the cyclone, but the initial concentration and the initial distribution of the MCMB were different from those in Experiment 2, the concentrating and classification effects were ample, and the process is highly adaptable.

EXPERIMENT 4

The same petroleum pitch as that used in Experiment 1 was suitably crushed, and quinoline in a quantity ten times that of the pitch was added thereto. These materials were then agitated at 80° C. to dissolve the pitch. Then, with the use of a No. 1 filter paper, the resulting solution was subjected to suction filtration to separate solid substances, which were further washed with quinoline and acetone thereby to obtain MCMB. These MCMB were mixed with 460 times their weight of light oil to form a suspension. Thereafter, this suspension was subjected to a 4-stage cyclone treatment by a method similar to that set forth in Experiment 3 except that the operation temperature was room temperature, and the cyclone inlet pressure was 3 kg/cm$^2$ gage.

Figure 8:
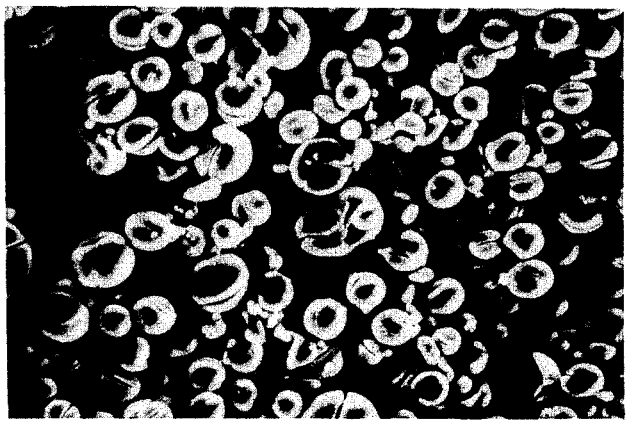

As a result, the liquid throughput rate was 3.5 liters/min., and, relative to an MCMB concentration of the feed liquid of 0.162 percent by weight, that of the underflow of the fourth-stage cyclone was 2.653 percent by weight. That is, the concentration ratio was 16.4. Ample classification effect was evident as indicated in FIG. 8. From these results, it is apparent that the use of liquids such as light oil, other than quinoline, as solvents for classification is also effective.

What is claimed is:

1. A process for continuously producing mesocarbon microbeads which comprises the steps of:

(a) mixing in a dissolving vessel (1) a starting-material pitch comprising a matrix pitch and mesophase microspheres obtained by heat processing a heavy oil and (2) a solvent in which the matrix pitch will dissolve but the mesophase microspheres will not dissolve thereby to obtain a liquid mixture comprising a solution of the matrix pitch dissolved in the solvent and dispersed mesophase microspheres;

(b) supplying the liquid mixture thus obtained in step (a) into at least two sequential stages of liquid cyclones (i) the first of said two stages separating the mixture into a light liquid portion comprising principally the matrix pitch and the solvent and a heavier liquid portion containing most of the mesophase microspheres, and (ii) the second of said two stages separating said heavier liquid portion into a medium-weight liquid containing the matrix pitch and the solvent as well as a small portion of fine mesophase microspheres, and a heavy liquid containing the solvent as well as most of the mesophase microspheres;

(c) evaporating the solvent from the light liquid thus obtained in step (b) thereby to separate and collect the matrix pitch;

(d) recycling the medium-weight liquid thus obtained in step (b) to step (a) or step (b); and (e) removing the solvent from the heavy liquid thus obtained in step (b) thereby to obtain mesophase microspheres as mesocarbon microbeads.

2. The process according to claim 1 in which the heavy liquid from step (b) is separated by at least two stages of liquid cyclones thereby to obtain at least two heavy liquids respectively containing mesophase microspheres of different average particle sizes, and the solvent is removed from each of the heavy liquids thereby to obtain classified mesocarbon microbeads.

3. The process according to claim 1 in which the removal of the solvent is carried out by evaporation thereof.

4. The process according to claim 1, 2, or 3 which further comprises, prior to the step (e), a mixing step wherein the heavy liquid from the step (b) is mixed with a dispersion medium differing from said solvent and does not dissolve also the matrix pitch thereby to obtain a liquid mixture, and in which, from the liquid mixture thus obtained, the solvent and the dispersion medium are evaporated in step (e) thereby to obtain mesocarbon microbeads.

5. The process according to claim 4 in which the solvent and dispersion medium recovered in step (e) are separated into the solvent and the dispersion medium, which are recycled respectively to step (a) and said mixing step.

6. The process according to claim 1 wherein the solvent is aromatic solvent.

7. The process according to claim 6 wherein said solvent is quinoline, pyridine or anthracene oil.

* * * * *